US006071318A

United States Patent [19]

Mallet et al.

[11] Patent Number: 6,071,318

[45] Date of Patent: Jun. 6, 2000

[54] BIFUNCTIONAL COLD RESISTANCE ADDITIVE FOR FUELS, AND FUEL COMPOSITION

[75] Inventors: Catherine Mallet, Lyons; Jean Rozier, Vaulx en Velin, both of France

[73] Assignee: Elf Antar France, Courbevoie, France

[21] Appl. No.: 08/973,460

[22] PCT Filed: Jun. 12, 1996

[86] PCT No.: PCT/FR96/00893

§ 371 Date: Feb. 20, 1998

§ 102(e) Date: Feb. 20, 1998

[87] PCT Pub. No.: WO96/41850

PCT Pub. Date: Dec. 27, 1996

[30] Foreign Application Priority Data

Jun. 13, 1995 [FR] France ..... 95 07008

[51] Int. Cl.[7] ..... C10L 1/22; C10L 1/14; C08F 8/32

[52] U.S. Cl. ..... 44/394; 44/391; 526/318

[58] Field of Search ..... 44/419, 394, 391; 526/318

[56] References Cited

U.S. PATENT DOCUMENTS 3,308,078 3/1967 Rogers et al. ..... 526/318.44
3,340,030 9/1967 Gaston et al. ..... 44/370
4,474,669 10/1984 Lewis .
4,664,676 5/1987 Denis .

FOREIGN PATENT DOCUMENTS 802 588 10/1958 United Kingdom .

*Primary Examiner*—Margaret Medley
*Attorney, Agent, or Firm*—Oblon, Spivak, McClelland, Maier & Neustadt, P.C.

[57] ABSTRACT

A bifunctional anti-settling and dispersant additive for middle distillates from 150–450° C. petroleum fractions, characterized in that consists of at least one modified copolymer with a weight-average molecular weight of 500–5000 prepared as follows: in a first step, a first carboxylic acid is copolymerized with an alkylated ester of a second carboxylic acid which is the same as or different from the first, and in a second step, the carboxylic groupings of the resulting copolymer re amidified at a temperature of 100–200° C.

(II)

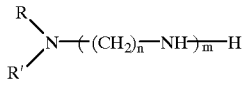

wherein n and m are from 1 to 8, and R and R' are preferably alkyl groupings.

10 Claims, No Drawings

BIFUNCTIONAL COLD RESISTANCE ADDITIVE FOR FUELS, AND FUEL COMPOSITION

This application is a 371 PCT/FR96/00893 filed Jun. 12, 1996.

The present invention relates to dual-function additives which make it possible to limit and prevent the sedimentation of paraffins contained in the refining fraction middle distillates of temperature between 150 and 450° C., and to maintain a good dispersion of crystals formed at these temperatures in order to improve the cold-temperature operability properties of these distillates down to temperatures below −10° C. and even below −20° C.

The invention is also directed towards additive compositions for improving the cold-temperature operability and also fuels and combustibles containing the said additive or these additive compositions.

It has long been known that the paraffins present in the middle distillates cause blocking and clogging at low temperatures by crystallization, sedimentation and deposition either during storage of these distillates or during their transportation in tankers, or during running in diesel motors or industrial or domestic boilers. Since the crystallization temperature of paraffins constitutes a limiting factor on the use of these middle distillates, it is common to add something to them in order to adapt them to the temperatures at which they will be used or stored.

Although cold operability temperatures of −10° C. are sufficient in many regions, it is preferable to aim at −20° C. in regions close to the polar circles or during winter.

In the description hereinbelow, the term combustible is used to denote additive-containing middle distillates, these either being motor fuels or fuels for boilers.

Adapting the cold-temperature operability of combustibles is an obligation especially in order to avoid the entrainment of paraffin crystals sedimented at the bottom of the reservoir or tank throughout the circuit, since these crystals hamper the normal circulation of the combustible and cause blocking and clogging, particularly during the cold-start of motors of land vehicles or of boilers connected to an outdoor storage.

In order to improve the cold-temperature operability of these combustibles, industrials have had to develop various additives with a variety of functions in order to lower their flow point, to lower their limit temperature for filterability and especially to limit the sedimentation of paraffin crystals in order to maintain a good dispersion of these crystals in the combustible.

Among the combustible additives derived from middle distillates, it is common to use dual-function additives as described in German patent DE 4,025,586, which combine the functions of filterability additive and additive for dispersing paraffin crystals, these additives resulting from the polymerization of compounds containing vinylaromatic units and unsaturated monocarboxylic acid units, aminated by reaction with a secondary monoamine.

In order to slow down or prevent the sedimentation of paraffin crystals in middle distillates and in order to limit their tendency to become emulsified in the presence of water, GB patent 2,269,824 claims additives obtained by reacting long-chain amines comprising from 12 to 22 carbon atoms with a carboxylic acid comprising an olefinic double bond and a carbon chain comprising from 17 to 24 carbon atoms in a mixture of solvents, one being non-polar and the other weakly polar.

The present invention is itself directed towards a dual-function anti-sedimentation and dispersion additive obtained by polymerization of two compounds containing carboxylic groups. The invention is aimed, for the Applicant, at substituting a single additive with a dual function for two additives which fulfil each of these two functions separately, in particular such as those mentioned in French patent application 2,710,652. These two additives with anti-sedimentation and dispersion functions, respectively, act in a synergistic manner; in this Application, the anti-sedimentation additive results from the reaction of an aliphatic carboxylic compound with a polyamine, and the dispersant/stabilizing additive is obtained by polymerization of an ester with an unsaturated dicarboxylic derivative. The use of only one additive instead of two has the advantage in particular of avoiding the demixing problems which are always liable to occur in the case of mixtures of two or more compounds, in particular in gasoils owing to combustible homogeneity problems.

The subject of the present invention is thus a dual-function anti-sedimentation and dispersion additive for middle distillates derived from petroleum fractions of temperatures between 150 and 450° C., characterized in that it consists of at least one modified copolymer with a weight-average molecular mass (KW) of between 500 and 5000 and preferably between 1000 and 2000, obtained in two steps, i) the first step consisting in copolymerizing at least one first unsaturated carboxylic acid substituted or unsubstituted with at least one alkyl ester of at least one second substituted or unsubstituted unsaturated carboxylic acid, which may or may not be identical to the first, these two monomers corresponding to the general formula (I)

(I)

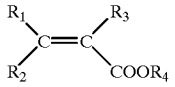

in which $R_1$ and $R_2$ are identical or different and are chosen from the group consisting of hydrogen and linear or branched alkyl groups comprising from 1 to 20 carbon atoms, $R_3$ is hydrogen or a linear alkyl group of not more than three carbon atoms and it being possible for $R_4$ to be either hydrogen in the said carboxylic acid or an alkyl group comprising from 1 to 25 carbon atoms in the said alkyl ester, the polymerization reaction being carried out in at least one, preferably aromatic, hydrocarbon solvent with a boiling point of between 70 and 250° C., at a temperature of between 100 and 200° C., ii) the second step consisting in amidating, at a temperature of between 100° C. and 200° C., the carboxylic groups of at least one solvated copolymer resulting from the said first step, with at least one polyamine of general formula (II) below;

(II)

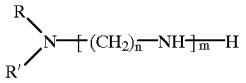

in which n and m are integers between 1 and 8, R is chosen from the group consisting of hydrogen and linear alkyl groups comprising from 1 to 5 carbon atoms and R' is a linear alkyl group comprising from 1 to 25 carbon atoms.

In the context of the present invention, the synthetic copolymer resulting from the first step contains from 45 to 65 mol % of at least one carboxylic acid unit and from 35 to 55 mol % of at least on alkyl ester unit.

In this specific embodiment of the invention, acrylic and methacrylic acids and their derivatives are preferred among the carboxylic acids, and acrylic and methacrylic esters and their derivatives are preferred among the alkyl esters.

Preferably, the preferred polymers for this first step are acrylic acid/methacrylic ester copolymers and methacrylic acid/acrylic ester copolymers.

In the alkyl ester units of the copolymers obtained after the first step, the groups $R_4$ are preferably linear alkyl chains comprising 12 and 18 carbon atoms.

In a preferred embodiment of the second step according to the invention, the integers n and m in the general formula (II) of the polyamine are, respectively, between 2 and 4 and between 1 and 4, with R' being an alkyl group preferably comprising 12 or 18 carbon atoms.

In order to obtain the dual-function additive according to the invention, the amidation reaction consists in reacting at least one polyamine of formula (II) with the copolymers resulting from the said first step, for a molar ratio of the said polyamine to the carboxylic groups of the said copolymers of between 0.3 and 0.8.

The additive according to the invention has the advantage over the prior art of fulfilling the same functions of anti-sedimentation and paraffin-crystal dispersion by means of a single additive instead of two above, and doing so down to at least −25° C.

A second subject of the invention is an additive composition comprising at least 40% by weight of the dual-function anti-sedimentation and dispersion additive.

In a preferred embodiment of this second subject of the invention, the composition comprises from 40 to 70% by weight of the said dual-function additive and from 30 to 60% by weight of at least one filterability additive.

This filterability additive is preferably chosen from the group consisting of ethylene/vinyl acetate copolymers, also referred to as EVA copolymers, and ethylene/vinyl propionate copolymers, also referred to as EVP copolymers.

A third subject of the present invention is the combustible containing at least one dual-function anti-sedimentation and dispersion additive according to the invention, and preferably the said composition.

In the preferred embodiment of this said combustible, it consists of a major proportion of middle distillate with a distillation point of between 150° C. and 450° C. and a minor proportion of the said additive and, in particular, a minor amount of the said composition.

Preferably, the combustible can contain from 0.01 to 0.20% by weight of the said composition relative to the middle distillate.

The middle distillates according to the invention are preferably domestic fuel oils and gasoils derived from paraffinic petroleum fractions whose distillation range is between 150 and 380° C. according to ASTM standard D86.

Such combustibles according to the invention are used either in diesel motors of land vehicles or in industrial or domestic boilers.

In the description hereinbelow, examples are given by way of non-limiting illustration of the scope of the present invention.

EXAMPLE 1

The present example describes the synthesis of dual-function additives according to the invention, in particular of polyacrylate/acrylamide type.

In a first step, methacrylic acid/acrylate copolymers or acrylic acid/methacrylate copolymers are prepared. In a second step, these copolymers are amidated.

First Step in the Synthesis of the Additive According to the Invention 0.85 g of a transfer agent, in this case dodecanethiol, in 11 g of Solvantar 340, an aromatic solvent sold by ELF ANTAR FRANCE, this mixture constituting the reaction mixture, is introduced into a 100 ml four-necked round-bottomed flask fitted with a stirrer, two dropping funnels and a thermometer.

A mixture consisting of 11 g of Solvantar 340 and 0.20 g of di-tert-butyl peroxide, acting as polymerization initiator, is introduced into one of the closed dropping funnels. For each of the two types of copolymer desired, the acid/ester mixture (the acrylic acids/methacrylates or methacrylic acid/acrylates mixtures) are introduced into the second dropping funnel in about 15 g of Solvantar 340. The flask is heated and is then maintained at a temperature of 140° C. in order to increase the temperature of the reaction mixture. At this temperature, 1 ml of the mixture containing the polymerization initiator is run into the reaction mixture. Next, the two mixtures in the two dropping funnels are introduced simultaneously and continuously into the reaction mixture, with continual stirring, over three hours. After complete addition of the reagents, the reaction mixture is maintained at 140° C. for a further 1 h 30 with stirring. The products of this synthesis are clear products straw-yellow to gold-yellow in colour, containing 50% by weight of active materials or copolymer.

Second Step in the Synthesis of the Additive According to the Invention, Corresponding to the Amidation One dropping funnel on the flask is replaced by a Dean-Stark type condenser in order to recover the water formed during this second step. In the flask maintained at 140° C., 0.30 g of amidation catalyst (para-toluene-sulphonic acid in this case) is added to the reaction medium containing the copolymer and a sufficient amount of triamine is then run in over less than five minutes, in order to amidate all of the available carboxylic functions COOH on the copolymer. The new reaction mixture thus obtained is heated and maintained at reflux between 175 and 185° C. for three hours, and the water formed is removed continuously. The product recovered is clear but brown-orange in colour: it contains 50% by weight of active materials.

Four dual-function additives according to the invention were prepared: Table 1 below gives the amounts of the carboxylic acid and carboxylic ester compounds used.

TABLE 1

| Additive | $X_1$ | $X_2$ | $X_3$ | $X_4$ | $X_5$ |
|---|---|---|---|---|---|
| Acid | | | | | |
| acrylic | 8.64 g | 8.64 g | 7.2 g | 7.2 g | |
| methacrylic | | | | | 10.3 g |
| Carboxylic ester | | | | | |
| dodecyl methacrylate | 5.2 g | 5.2 g | 9.7 g | 9.7 g | |
| octadecyl methacrylate | 20 g | 20 g | 20.9 g | 20.9 g | |
| octadecyl acrylate | | | | | 38.9 g |

TABLE 1-continued

| Additive | $X_1$ | $X_2$ | $X_3$ | $X_4$ | $X_5$ |
|---|---|---|---|---|---|
| Solvantar (1st step) | 15 g | 15 g | 15 g | 15 g | 15 g |
| Triamine: | | | | | |
| $C_{12}$ long chain | | 20.7 g | | 17.3 g | |
| $C_{18}$ long chain | 24.6 g | | 20.7 g | | |
| tetraethyl-pentamine | | | | | 11.4 g |
| Solvantar (2nd step) | 20 g | 20 g | 20 g | 20 g | 20 g |
| $M_w$ (by weight) | 1100 | 1370 | 1160 | 1700 | 1200 |

EXAMPLE II

The present example is aimed at showing the efficacy of the dual-function additives according to the invention, $X_1$, $X_2$, $X_3$, $X_4$ and $X_5$ in their anti-sedimentation and dispersion dual-functionality in various middle distillates in the presence of a filterability additive, by comparison with these same gasoils containing only the filterability additive. This example is also aimed at comparing the efficacy of these compositions with that of a control composition T obtained by mixing the three additives, according to application FR 2,710,652.

Three gasoils or middle distillates, referred to as A, B and C, received additives: their characteristics given in Table 2 below.

TABLE 2

| | A | B | C |
|---|---|---|---|
| PT (° C.) | −3 | −9 | −2 |
| T.L.F. (° C.) | −3 | −7 | −2 |
| PE (° C.) | −15 | −12 | −9 |
| DISTILLATION: | | | |
| PI (° C.) | 176 | 162 | 181 |
| 5% | 199 | 185 | 208 |
| 10% | 208 | 194 | 220 |
| 20% | 222 | 212 | 237 |
| 30% | 238 | 230 | 251 |
| 40% | 252 | 246 | 264 |
| 50% | 264 | 260 | 276 |
| 60°% | 277 | 274 | 288 |
| 70° C. | 291 | 287 | 300 |
| 80% | 310 | 304 | 315 |
| 90% | 338 | 325 | 337 |
| 95% | 361 | 340 | 354 |
| PF | 371 | 354 | 363 |
| 90%–20% (° C.) | 116 | 142 | 100 |
| PF–90% (° C.) | 33 | 29 | 26 |
| MV 15 (kg/l) | 0.8372 | 0.8352 | 0.8297 |
| PEC (° C.) | 70 | 65 | 75 |
| % by weight of paraffins in the gasoil | 11.9 | 15.4 | 15.8 |
| % by weight of paraffins < $C_{13}$ | 8.8 | 9.7 | 7 |
| % by weight of $C_{13}$ to $C_{17}$ paraffins | 75.2 | 66 | 72 |
| % by weight of $C_{17}$ to $C_{23}$ paraffins | 16 | 22 | 21 |

In each of the three gasoils A, B and C, 0.06% by weight of a filterability additive or TLF, CE 3144 sold by BASF, was added in order to form the control samples.

In a second stage, additive-containing gasoil samples according to the invention are prepared comprising 0.06% by weight of the composition according to the invention which comprises 60% by weight of TLF additive (the same as that mentioned above), and 40% by weight of one of the five samples of dual-function additives according to Example 1 of the invention.

In order to analyze the efficacy of the introduction of additive, each additive-containing gasoil is conditioned in a closed 250 $cm^3$ measuring cylinder placed in a cold cupboard at −15° C. for 24 hours. After 24 hours, the homogeneity of the sample, which is characteristic of nature and quality of the various phases present, is observed. In addition, the temperature of the cloud point of the upper and lower phases present in the measuring cylinder is measured according to ISO method 3015. The T.L.F. or filterability temperature of the lower phase in the measuring cylinder is measured according to European standard EN 116.

When, in the measuring cylinder, the upper phase is cloudy, a large proportion of paraffins has remained in suspension and the anti-sedimentation function of the additive is effective. When this phase is clear, the paraffins have generally fallen to the bottom of the measuring cylinder and have sedimented out.

Moreover, the closer the starting crystallization temperatures of the lower and upper phases, and the closer the TLF values, the more homogeneous the gasoil remains during the 24 hours of cold treatment, and thus the better the dispersion.

The details of the composition and of the efficacies of the additives and of the compositions tested are given in Table 3 below.

TABLE 3

| | Sedimented phase % vol. | Cloudy phase % vol. | Clear phase % vol. | Cloud point temperature difference (° C.) | T.L.F. difference (° C.) | T.L.F. (° C.) |
|---|---|---|---|---|---|---|
| TLF | | | | | | |
| GO A | 56 | 0 | 44 | | | −18 |
| GO B | 28 | 0 | 72 | | | −16 |
| GO C | 36 | 0 | 64 | | | −15 |
| $X_1$ + TLF | | | | | | |
| GO A | 0 | 100 | 0 | −2 | −2 | −22 |
| GO B | 12 | 88 | 0 | −9 | −3 | −14 |
| GO C | 0 | 100 | 0 | −1 | −2 | −15 |
| $X_2$ + TLF | | | | | | |
| GO A | 0 | 100 | 0 | −1 | +2 | −19 |
| GO B | 12 | 88 | 0 | −10 | 0 | −15 |
| GO C | 84 | 16 | 0 | −6 | −3 | −18 |
| $X_3$ + TLF | | | | | | |
| GO A | 12 | 88 | 0 | −6 | −4 | −23 |
| GO B | 8 | 92 | 0 | −8 | −2 | −14 |
| GO C | 0 | 100 | 0 | −2 | −3 | −17 |
| $X_4$ + TLF | | | | | | |
| GO A | 0 | 100 | 0 | −2 | −2 | −22 |
| GO B | 12 | 88 | 0 | −2 | 0 | −17 |
| GO C | 0 | 100 | 0 | −2 | 0 | −17 |
| $X_5$ + TLF | | | | | | |
| GO A | 6 | 94 | 0 | −4 | −3 | |
| T* | | | | | | |
| GO B | 3 | 97 (slightly cloudy) | 0 | −3 | −1 | −12 |
| GO C | 48 | 52 | 0 | −11 | −2 | −11 |

TABLE 3-continued

| | Sedimented phase % vol. | Cloudy phase % vol. | Clear phase % vol. | Cloud point temperature difference (° C.) | T.L.F. difference (° C.) | T.L.F. (° C.) |
|---|---|---|---|---|---|---|
| | | (slightly cloudy) | | | | |

*T = 40% TLF + 36% (anti-sedimentation additive CP 9555 sold by ELF Antar France) + 24% dispersant/stabilizing agent (according to patent application FR 2,710,652)

Table 3 confirms that a dual-function additive according to the invention, combined with a filterability additive, has good anti-sedimentation and dispersion properties when compared with the TLF additive alone and with a mixture containing 3 compounds as described in application FR 2,710,652, irrespective of the nature and distribution of the paraffin-chain compounds in the gasoils. The additive samples according to the invention X1 to X5 improve the cold-temperature operability of the gasoils while at the same time greatly limiting the sedimentation of the paraffin crystals (a sedimented phase of low volume and differences between the cloud points of the lower and upper phases in the measuring cylinder of less than 10, in terms of absolute value, are obtained).

In addition, the results underline the universality of the composition of the invention in various types of gasoil, gasoils A, B and C being characteristic of these. In addition, no demixing occurred with compositions X1 to X5 even after several days.

What is claimed is:

1. A dual-function anti-sedimentation and dispersion additive for middle distillates derived from petroleum fractions of temperatures between 150 and 450° C., characterized in that said additive comprises at least one modified copolymer with a weight-average molecular mass (MW) of between 500 and 5000, obtained in two steps, i) the first step comprising copolymerizing a mixture of monomers all of which have structural formulae within the general formula (I)

(I)

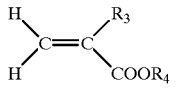

in which $R_3$ is hydrogen or methyl, $R_4$ is either hydrogen or an alkyl group of from 1 to 25 carbon atoms, the copolymerization reaction being carried out in at least one hydrocarbon solvent with a boiling point of between 70 and 250° C., at a temperature of between 100 and 200° C., the monomers being selected so that the said copolymer contains from 45 to 65 mol % of at least one monocarboxylic acid unit in which $R_4$ is hydrogen; and from 55 to 35 mol % of at least one alkyl monocarboxylic acid ester unit, in which $R_4$ is an alkyl group of from 1 to 25 carbon atoms; characterized in that the copolymers resulting from the first step are chosen from the group consisting of acrylic acid/methacrylic ester copolymers and methacrylic acid/acrylic ester copolymers;

ii) the second step comprising amidating, at a temperature of between 100° C. and 200° C., the carboxylic groups of at least one solvated copolymer resulting from the said first step, with at least one polyamine of general formula (II) below:

(II)

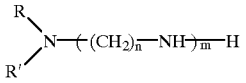

in which n and m are integers between 1 and 8, R is chosen from the group consisting of hydrogen and linear alkyl groups of from 1 to 5 carbon atoms and R' is a linear alkyl group of from 1 to 25 carbon atoms.

2. An additive according to claim 1, wherein the copolymer is of weight-average molecular weight of between 1000 and 2000.

3. A dual-function anti-sedimentation and dispersion additive for middle distillates derived from petroleum fractions of temperatures between 150 and 450° C., characterized in that said additive comprises at least one modified copolymer with a weight-average molecular mass (MW) of between 500 and 5000, obtained in two steps, i) the first step comprising copolymerizing a mixture of monomers all of which have structural formulae within the general formula (I)

(I)

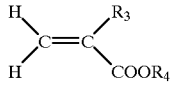

in which $R_3$ is hydrogen or methyl and $R_4$ is either hydrogen or an alkyl group of 12 or 18 carbon atoms, the copolymerization reaction being carried out in at least one hydrocarbon solvent with a boiling point of between 70 and 250° C., at a temperature of between 100 and 200° C., the monomers being selected so that the said copolymer contains from 45 to 65 mol % of at least one monocarboxylic acid unit in which $R_4$ is hydrogen; and from 55 to 35 mol % of at least one alkyl monocarboxylic acid ester unit, in which $R_4$ is an alkyl group of from 12 or 18 carbon atoms; characterized in that the copolymers resulting from the first step are chosen from the group consisting of acrylic acid/methacrylic ester copolymers and methacrylic acid/acrylic ester copolymers, that, in the alkyl ester units of the copolymers obtained after the first step, the groups $R_4$ are linear alkyl chains of 12 or 18 carbon atoms;

ii) the second step comprising amidating, at a temperature of between 100° C. and 200° C., the carboxylic groups of at least one solvated copolymer resulting from the said first step, with at least one polyamine of general formula (II) below:

(II)

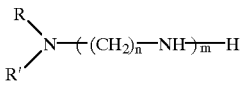

in which R is chosen from the group consisting of hydrogen and linear alkyl groups of from 1 to 5 carbon atoms, and characterized in that, in the general formula (II) of the polyamine, the integers n and m are, respectively, between 2 and 4 and between 1 and 4 with R' being a linear alkyl group having 12 or 18 carbon atoms.

4. An additive concentrate for improving the cold temperature operation of petroleum middle distillates comprising a solvent and at least 40% by weight of the dual-function anti-sedimentation and dispersion additive according to claim 3.

5. An additive composition, characterized in that it comprises from 40 to 70% by weight of a dual-function additive according to claim 3 and from 30 to 60% by weight of at least one filterability additive chosen from the group consisting of ethylene/vinyl acetate copolymers and ethylene/vinyl propionate copolymers.

6. A combustible comprising a middle distillate derived from petroleum fractions of temperatures been 150 and 450° C. and at least.

7. A combustible according to claim 6, characterized in that it consists of a major proportion of middle distillate with a distillation point of between 150° C. and 450° C. and a minor proportion of the said additive.

8. A combustible composition comprising a major proportion of a middle distillate with a distillation point between 150 and 450° C. and a minor proportion of the composition of claim 5.

9. A combustible according to claim 8, characterized in that it comprises from 0.01 to 0.20% by weight of the said composition relative to the middle distillate.

10. A combustible according to claim 9, characterized in that the middle distillate is chosen from the group consisting of domestic fuel oils and gasoils derived from paraffinic petroleum fractions whose distillation range is between 150 and 380° C., according to ASTM standard D86.

* * * * *